United States Patent [19]

Enkner et al.

[11] Patent Number: 4,678,419

[45] Date of Patent: Jul. 7, 1987

[54] ARRANGEMENT FOR THE PRODUCTION OF VITRIFIED SLAG

[75] Inventors: Bernhard Enkner; Dietmar Stephani; Leopold Schropp, all of Linz; Wilhelm Stastny, Alberndorf, all of Austria

[73] Assignee: Voest-Alpine Aktiengesellschaft, Linz, Austria

[21] Appl. No.: 835,160

[22] Filed: Mar. 3, 1986

[30] Foreign Application Priority Data

Mar. 15, 1985 [AT] Austria ..... 775/85

[51] Int. Cl.[4] ..... B28B 17/00

[52] U.S. Cl. ..... 425/143; 425/147; 425/218; 425/223; 425/406

[58] Field of Search ..... 425/143, 147, 218, 223, 425/224, 406; 264/299, 165, 212, 314, 297.6, 40.4, 40.7

[56] References Cited

U.S. PATENT DOCUMENTS 2,717,419 9/1955 Dickey ..... 264/297.6

FOREIGN PATENT DOCUMENTS 375959 2/1984 Austria .

53-34038 3/1978 Japan .

56-77100 6/1981 Japan ..... 264/40.4

*Primary Examiner*—Bernard Nozick

*Attorney, Agent, or Firm*—Collard, Roe & Galgano

[57] ABSTRACT

An arrangement for the production of vitrified slag includes a rotating cooling drum provided with an internal cooling and on whose surface molten-slag-receiving recesses are provided. The site of impact of the slag is approximately at the uppermost point of the cooling drum. In order to ensure the vitrification of the slag with the flowing of molten slag off the cooling drum being reliably prevented, and an economic production of solidified slag being ensured, the recesses are separated by webs in the circumferential direction of the cooling drum and in the end region of the cooling drum are designed to be closed in the axial direction thereof. A plurality of cooled counter rolls contacting the webs by their surfaces and aligned with their axes parallel to the cooling drum are provided. They are arranged after the site of impact of the slag in the rotation direction of the cooling drum and one behind the other in its circumferential direction.

28 Claims, 13 Drawing Figures

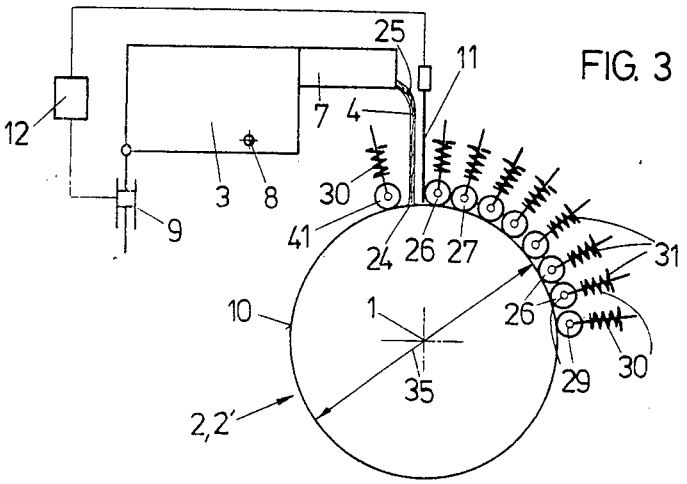
FIG. 3
FIG. 4
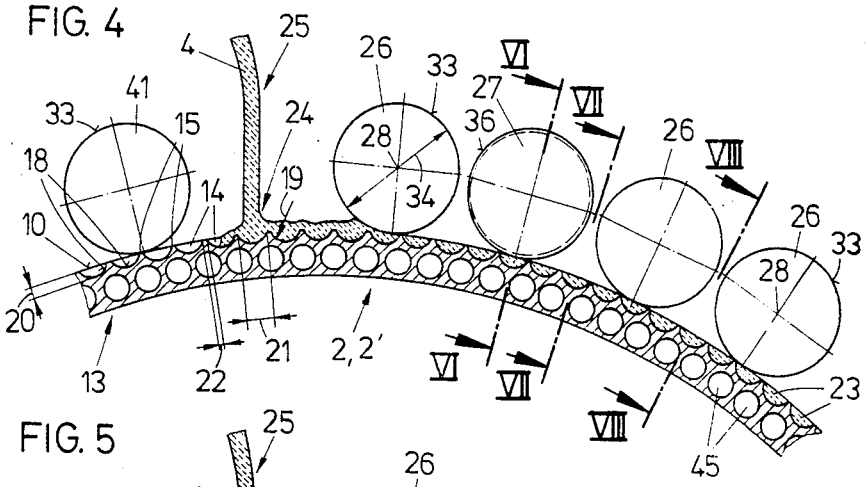
FIG. 5
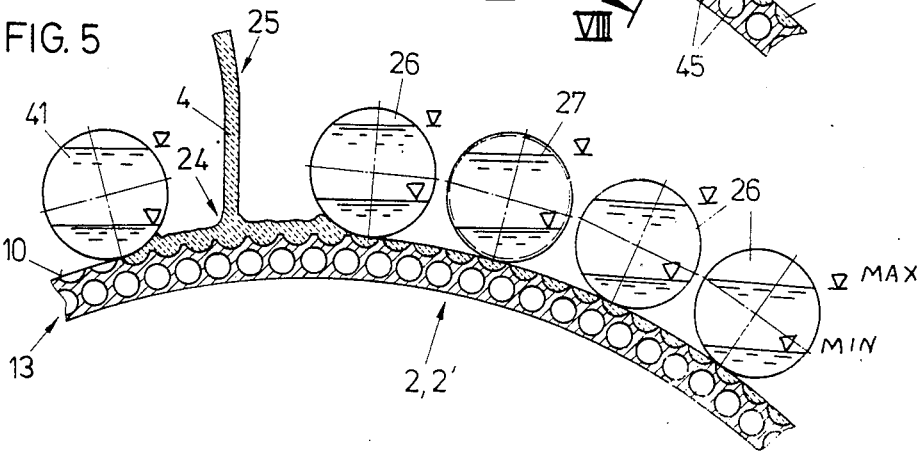

ARRANGEMENT FOR THE PRODUCTION OF VITRIFIED SLAG

The invention relates to an arrangement for the production of vitrified slag, in particular blast furnace slag, comprising a rotating cooling drum provided with an internal cooling and on whose surface molten-slag-receiving recesses are provided, the site of impact of the slag being approximately at the uppermost point of the cooling drum.

An arrangement of this type is known from Japanese Kokai No. 53-34038 as well as from Austrian Pat. No. 375,959. According to this prior art, slag is allowed to impinge on a cooling drum at its uppermost point, wherein, however, vitrification of the slag is ensured only for part of the slag, i.e., that part which directly contacts the cooling drum.

In order to prevent molten slag from dripping down the cooling drum, an extremely sensitive control of the slag supply is required. Already with slight deviations of the supplied slag amount, there is the danger that excess molten slag drips from the cooling drum in a molten state.

From Austrian Pat. No. 375,959 it is known to allow slag to flow onto the uppermost sites of two oppositely arranged and counterdriven cooling drums, which drums are provided with grooves extending in the circumferential direction. Even in that case, molten slag 25 may rund own through the grooves.

It is, furthermore, known from Austrian Pat. No. 375,959 to provide two oppositely arranged and counterdriven drums with recesses in their surfaces, two recesses each complementing another on the contact site of the drums to form a hollow sphere. The slag is allowed to flow in centrally between the drums such that a sump of molten slag forms between the drums. This has, however, the disadvantage that the slag will solidify on the borders of the sump, depositing even on the contacting surfaces of the two cooling drums. Thereby, the direct contact of the surfaces of the cooling drums will be interrupted in some points and molten slag again may flow down the drum surfaces.

The invention aims at avoiding these difficulties and has as its object to provide an arrangement for the production of vitrified slag, in which the slag is completely solidified when leaving the cooling drum. On the one hand, the flowing of molten slag off the cooling drum is to be reliably prevented, on the other hand, however, an economic production of solidified slag, i.e., an adequately high output per time unit, is to be achieved, to which end a particularly effective cooling of the slag is required when it starts to solidify.

This object is achieved according to the invention in that the recesses are separated by webs in the circumferential direction of the cooling drum and in the end region of the cooling drum are designed to be closed in the axial direction thereof, and that a plurality of cooled counter rolls contacting the webs by their surfaces and aligned with their axes parallel to the cooling drum are provided, which are arranged after the site of impact of the slag in the rotation direction of the cooling drum and one behind the other in its circumferential direction, the recesses advantageously extending in the direction of the axis of the cooling drum and, preferably, being designed as grooves extending approximately over the total length of the cooling drum.

The cooled counter rolls ensure the hardening of the slag received by the recesses on the surface directed to the counter rolls so that, after the first counter roll, the slag will be solidified at least on its surface.

Preferably, the recesses have smooth surfaces, which are of round, suitably circularly segment-shaped, cross sections, thus facilitating the automatic detachment of the slag bodies filling the recesses from the cooling drum, and ensuring the automatic dropping down of these slag bodies from the cooling drum. In this case, shrinking of the slag bodies in the transverse direction plays an important part, because, due to this shrinkage, wedge gaps form between the slag bodies and the recesses, on account of which the slag bodies will loose their cohesion to the surfaces of the recesses.

Advantageously, the radius of the circularly segment-shaped recesses lies between 10 and 40 mm, preferably at about 15 mm.

Suitably, the recesses are arranged to be closely adjacent in the circumferential direction and the width of the webs is between 0.5 and 5 mm, whereby a slight pressing pressure of the counter rolls will do to prevent molten slag from flowing off between counter roll and web. In order to ensure the vitrification of the slag, a cross section is formed by the surface of each recess and the cylindrical surface of the cooling drum connecting neighboring webs, no point of the cross-sectional area of which is spaced from the nearest cross-sectional limitation by more than 10 mm. By this measure, it is taken into account that the slag has a very low thermal conductivity and that the heat can be conducted away from the core of the slag body via the cooling drum surface only to a limited extent within a predetermined period of time.

According to a preferred embodiment, at least three counter rolls are provided, the first and last of which have smooth surfaces, while the counter roll arranged therebetween, on its surface, is provided with elevations extending over its circumference. The counter roll with elevations, which lies between the counter rolls having smooth surfaces, causes the indentation of grooves into the slag body, which grooves are rolled into a narrow gap by the consecutively arranged smooth-surface counter roll. This gap forms a predetermined breaking point for the solidified slag body, which, together with the thermal stress growing during cooling of the slag body, causes the slag to burst asunder.

Preferably, the counter rolls are resiliently pressed against the webs of the cooling drum by a pressing means, whereby slag adhering to the webs may easily be rolled over by the counter rolls without molten slag being able to flow down.

According to a preferred embodiment, the counter rolls have a substantially smaller diameter as compared to the diameter of the cooling drum, preferably lying in a range of from 1/20 to 1/60 of the diameter of the cooling drum, whereby it is possible to provide a plurality of counter rolls along a small surface region of the cooling drum, which is beneficial to the rapid cooling and the vitrification of the slag.

Suitably, the point of impact of the slag, seen in the rotation direction of the cooling drum, lies closely in front of the apex of the cooling drum, preferably in a range of between 3° and 10° in front of the apex of the cooling drum, the first counter roll following upon the point of impact of the slag advantageously in a range of from 5° to 15°, preferably 7° to 12°. By this measure, the formation of a liquid sump between cooling drum and counter rolls is effectively inhibited.

In order to prevent molten slag from flowing off counter to the rotation direction of the cooling drum, at least one additional counter roll having a smooth surface and also contacting the webs is provided in front of the site of impact of the slag for reasons of safety, which additional counter roll suitably is spaced from the point of impact of the slag by 5° to 15°, preferably 7° to 12°.

The effective transmission of the heat contained in the slag into the coolant via the cooling drum suitably is facilitated by providing the shell of the cooling drum with a plurality of coolant channels substantially extending in the direction of the axis of the cooling drum and through which a coolant flows. This measure offers the advantage that the wall thickness between the recesses and the coolant channels may be kept very low and that the cooling drum itself need not be designed as a pressure vessel. Nevertheless, the coolant may be under a high pressure, in which case the coolant may have a high temperature, thus, enabling an effective thermal recovery.

Suitably, one coolant channel each is provided closely below a web in the radial direction, whereby the entire surface of the recess may be effectively cooled.

A preferred embodiment is characterized in that the coolant channels, by means of radially directed portions, each enter into stationary coolant supply and coolant discharge means divided into at least two chambers in the circumferential direction, wherein the first chamber of the coolant supply means is connected to the coolant feed duct and the first chamber of the coolant discharge means, into which coolant channels in communication with the first chamber of the coolant supply means enter, is flow-connected with the second chamber of the coolant supply means via a connecting channel and a further chamber of the coolant discharge means is flow-connected with the coolant discharge duct. This embodiment makes possible to provide the cooling drum part that gets into contact with the molten slag always with the coolest cooling water.

Preferably, the coolant supply and coolant discharge means in this case are designed as hollow ring cylinders, which are divided into individual chambers by radial webs, the connecting channels connecting the chambers are provided centrally within the ring cylinders and the radially directed portions of the coolant channels enter into the open extenal periphery of the chambers, which offers a cooling that is simple in terms of construction.

Suitably, the connecting channels connecting the chambers are formed by radially directed webs in the interior of a cylinder cavity connecting the coolant supply and coolant discharge means.

In order to prevent slag from overflowing on the end sides of the cooling drum, sensors, preferably temperature-sensitive sensors, advantageously are arranged laterally of the cooling drum near the ends of the recesses, which respond at an overflow of slag over the recesses, reducing the slag amount supplied per time unit by a control means, preferably by means of a tilting drive tilting a tundish.

The invention will now be explained in more detail by way of the drawings, wherein:

FIG. 3 is a side view, of the arrangement according to the invention, in schematic illustration;

Figure 6:
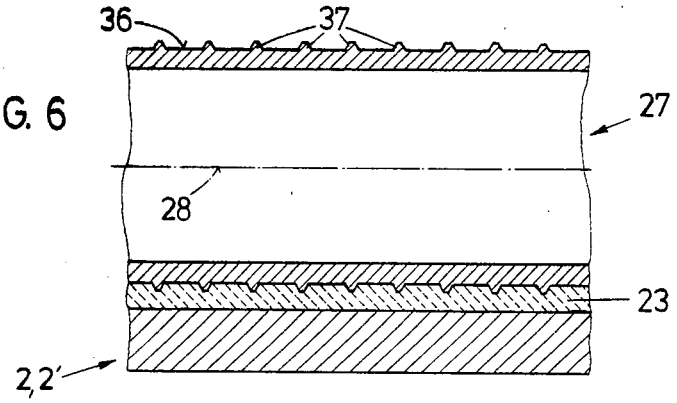
Figure 7:
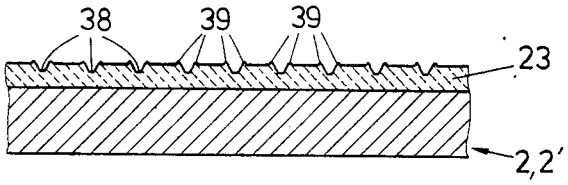
Figure 8:
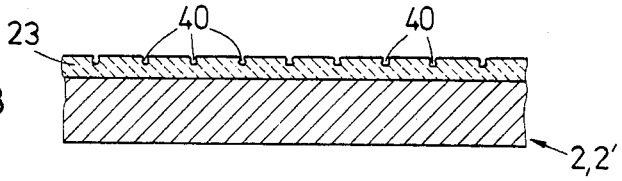
Figure 11:
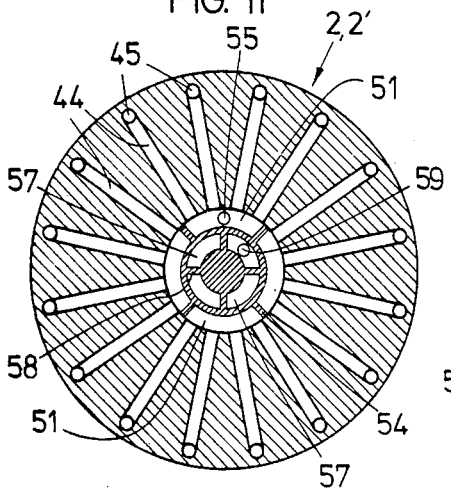
Figure 12:
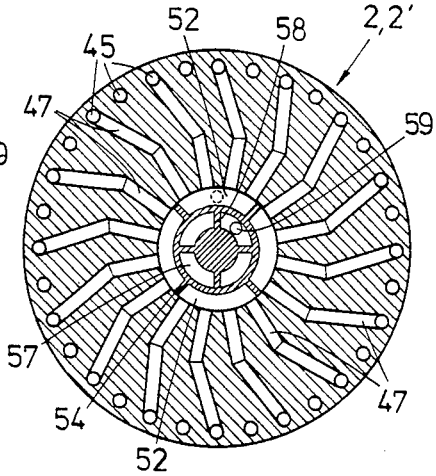
Figure 9:
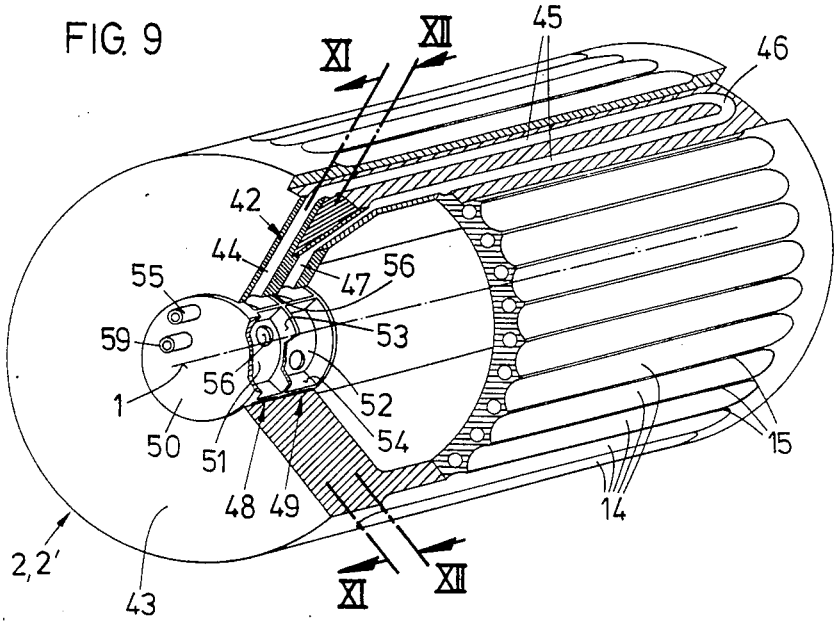
Figure 10:
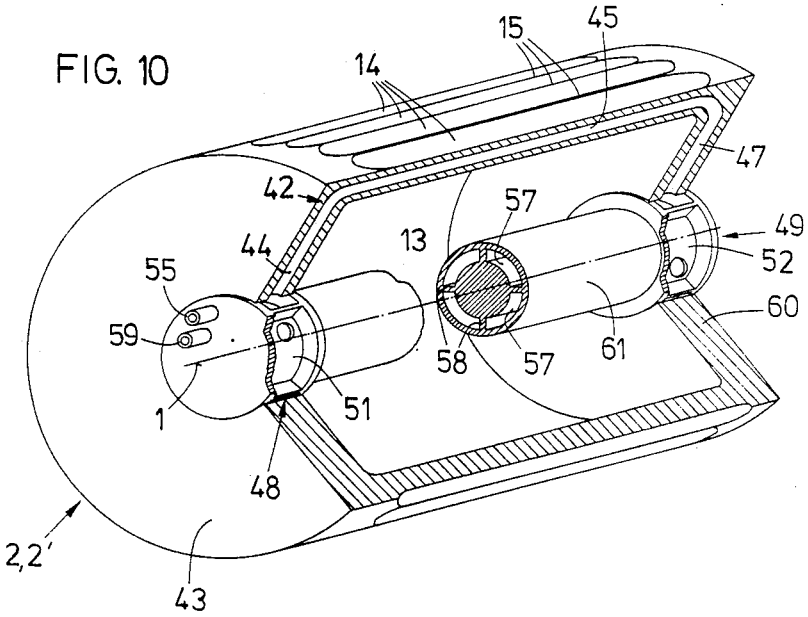
Figure 13:
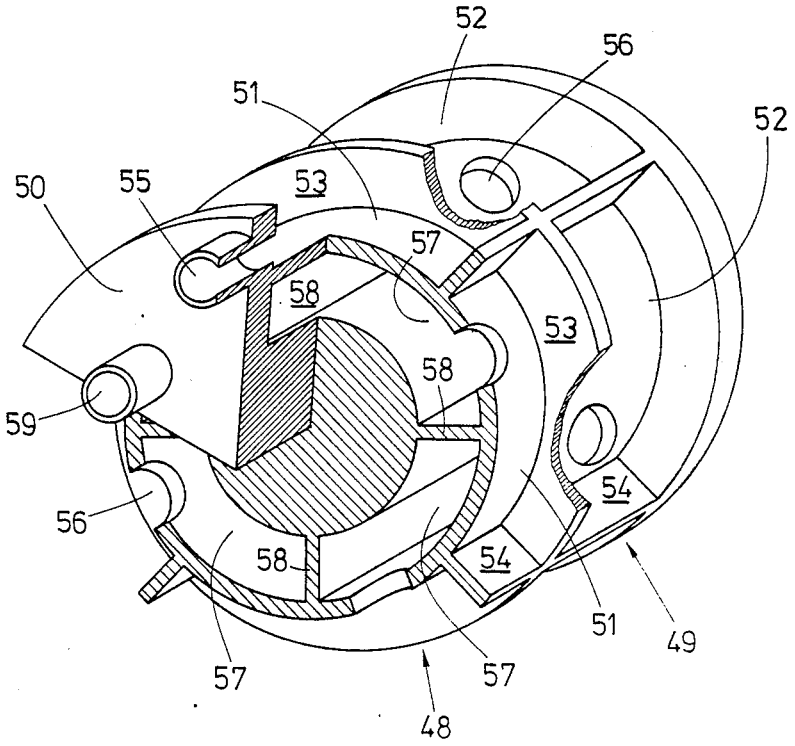

FIG. 4, in an illustration analogous to FIG. 3, illustrates a section of FIG. 3 on an enlarged scale at normal operation;

FIG. 5 shows the same section at emergency operation;

FIG. 6 is a section along line VI—VI of FIG. 4;

FIGS. 7 and 8 illustrate sections laid along lines VII—VII and VIII—VIII, respectively, of FIG. 4;

FIGS. 9 and 10 are each partially sectioned isometric views of a respective embodiment of a cooling drum;

FIGS. 11 and 12 are sections along lines XI—XI and XII—XII, respectively, of FIG. 9; and FIG. 13 illustrates a detail of FIG. 9 on an enlarged scale, partially sectioned in a different way.

Figure 1:
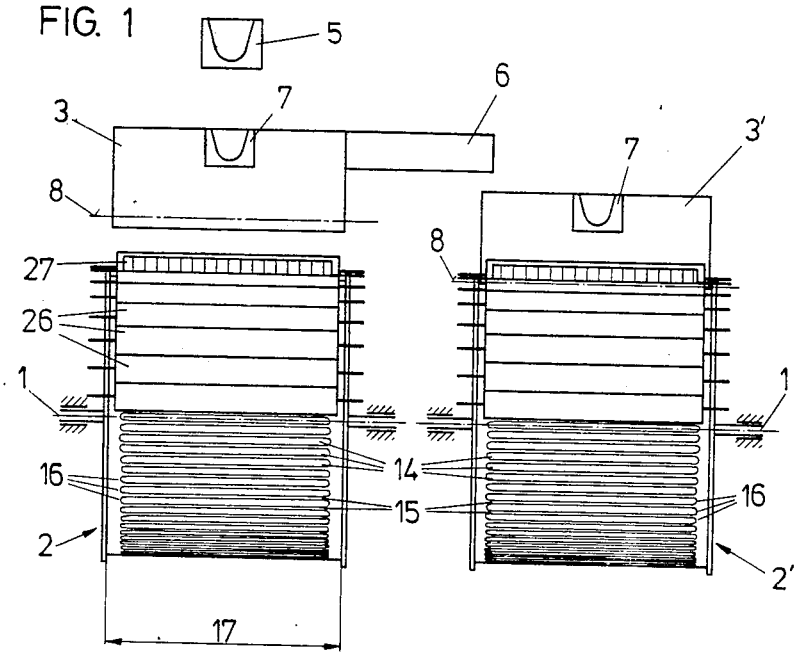
FIG. 1 is a front view.
Figure 2:
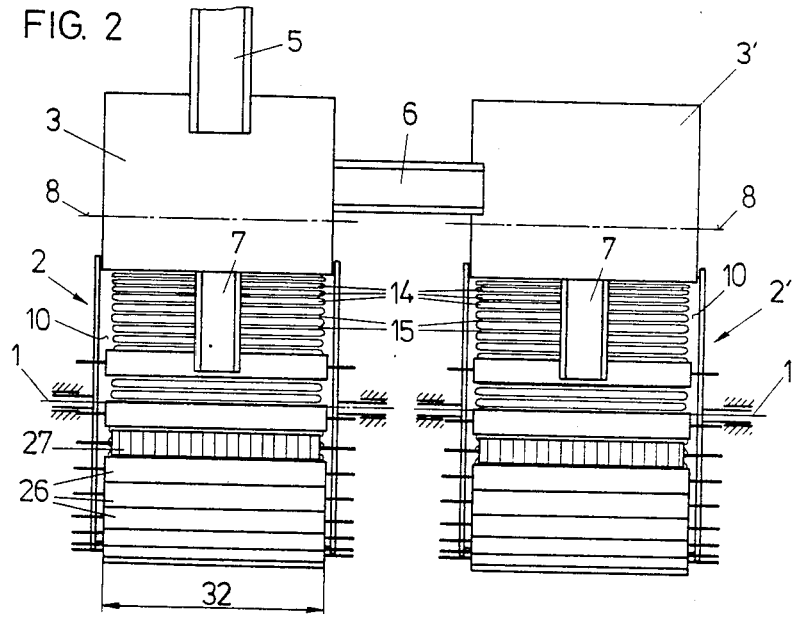
FIG. 2 is a top view.

According to the embodiment illustrated in FIGS. 1 and 2, two cooling drums 2, 2′ adjacently arranged with their axes 1 aligned are each rotatably journaled beneath a tundish 3, 3′. The tundishes 3, 3′ are supplied with slag 4 (see FIGS. 4 and 5) from a slag ladle (not illustrated), the slag leaving the slag ladle getting into the first tundish 3 via a slag chute 5. If more slag is supplied than can be processed by the first cooling drum 2, the slag flows into the adjacent tundish 3′ via an overflow chute 6.

The slag 4 flows from the tundish 3, 3′ onto the cooling drums 2, 2′ via discharge spouts 7, wherein the outflowing amount may be adjusted by tilting the tundishes 3, 3′ about their tilting axes 8. A tilting drive 9 hinged to the tundishes 3, 3′ serves for tilting, which tilting drive can be controlled in dependence on sensors 11 provided laterally on the surface 10 of the cooling drums 2, 2′ via a control device 12.

Each cooling drum 2, 2′ has a shell 13 provided with an internal cooling, on whose surface 10 groove-like recesses 14 extending parallel to the axis 1 of each cooling drum 2, 2′ are provided. These recesses 14, in the circumferential direction of the cooling drum 2, 2′, are separated by webs 15 and, on the end side of the cooling drum, are closed by rims 16 reaching as high as the webs. The recesses 14 preferably extend over the total length 17 of each cooling drum 2, 2′; however, it is also possible to divide each recess 14 into individual recesses neighboring in the direction of the axis 1 by transverse webs.

The recesses 14 have smooth surfaces 18 and are of round cross sections, i.e., they have no corners or edges in the cross section, because such corners or edges would complicate or impair detachment of the slag 4 solidified in the recesses. Preferably, the recesses 14 have circularly segment-shaped cross sections, the radius 19 being about 15 mm. The depth 20 of the recesses 14 on their deepest point also is about 15 mm, their width 21 amounting to approximately 25 to 30 mm. The recesses are so closely adjacent that the webs 15 present between the recesses have a width 22 of about 1 to 3 mm.

On account of the special cross-sectional shape of the recesses 14 described above, the slag bodies 23 cast into the recesses are easy to detach, because, due to the shrinkage of the slag bodies during cooling, a wedge-shaped gap must automatically form between the surface 18 of each recess 14 and the slag body 23, so that the solidified slag body 23 contacts the surface 18 of the recess 14 only along a line. The site of impact 24 of the slag jet 25 is near the uppermost point of the cooling drum, i.e., about 7° in front of the highest point of the cooling drum (seen in the rotation direction of the cooling drum).

Immediately after the site of impact 24, seen in the rotation direction of the cooling drum, there are a number of counter rolls 26, 27 contacting the surface 18 of the cooling drums 2, 2' and provided with internal coolings, the axes 28 of the counter rolls 26, 27 being aligned to be parallel to the axis 1 of the cooling drum 2, 2'. The coolant is supplied to, and discharged from, the counter rolls 26, 27 by means of a rotary connection (not illustrated).

The counter rolls 26, 27, on their end sides, are rotatably journaled, wherein the bearings 29 are pressable at the surfaces 10 of the cooling drums 2, 2' by elastic adjustment means, preferably by means of springs 30, the contact of the counter rolls 26, 27 with the cooling drums 2, 2' and the rotational movement of the non-driven counter rolls 26, 27 thus being ensured. The springs 30 are supported on a stationary structure part 31. The bearings of the counter rolls may be guided along guides (not illustrated). The first counter roll 26 is located behind the impact site 24 of the slag jet 25 by about 10° in the rotation direction, as illustrated in FIG. 3.

The length 32 of the counter rolls 26 is dimensioned such that they also abut against the front-side rims 16 of the cooling drums 2, 2' so as to prevent the counter rolls 26 from sinking into the recesses 14. The surfaces 33 of the counter rolls 26 are entirely smooth. The diameter 34 of the counter rolls 26, 27 is substantially smaller than the diameter 35 of the cooling drums 2, 2', it amounts to about 1/30 in the embodiment illustrated.

The second counter roll 27, seen in the rotation direction of the cooling drum 2, 2', is designed to be shorter than the remaining counter rolls 26 such that it is pressed into the recesses 14. As seen in FIGS. 6 and 7, on its surface 36, it comprises elevations 37 extending over its circumference, which press grooves 38 into the slag bodies 23 still readily deformable at the location of the second counter roll 27. There forms a small prominence 39 on either side of each pressed-in groove during pressing, which prominences 39 are squeezed by the following counter roll 26, which again has a smooth surface 33 like all the other counter rolls, so that closely neighboring gaps 40 will form in each slag body 23, extending transversely to the longitudinal direction of each slag body 23, as is illustrated in FIG. 8. These gaps 40 constitute predetermined breaking points for the solidified slag bodies 23. With an increasing cooling of the slag bodies 23, the thermal stresses within the slag bodies 23 will rise until the slag body 23 bursts asunder due to the indented gaps 40.

The cross-sectional shape of the elevations 37 extending in the circumferential direction has been chosen with a view to an easy detachment of the slag 4 from these elevations 37 during indenting.

In front of the site of impact of the slag on the surface of the cooling drum, a further counter roll 41 is arranged, which also has a smooth surface 33 and is dimensioned so long that it also abuts on the end-wall-side rims 16 by means of springs 30. The purpose of this counter roll 41 is to prevent slag 4 from flowing off counter to the rotation direction of the cooling drums 2,2' in the event that more slag per time unit impinges on the cooling drums 2, 2' than the latter are able to accommodate by their recesses 14 and convey from the site of impact 24. In this case, also the end-sidely provided sensors 11 will respond, causing the tundish 3 or 3' to pivot with a view to reducing the amount of slag flowing out. By this measure, the formation of too thick a slag layer on the surface 10 of the cooling drums 2, 2' is prevented. The condition illustrated in FIG. 5, which represents presents an emergency situation, thus, is restored into the operational condition illustrated in FIG. 4 within a very short time.

The internal cooling of the cooling drum 2, 2' is comprised of cooling channels 42 of circular cross sections, one cooling channel 42 each being provided closely below a web 15 in the radial direction with respect to the axis 1 of the cooling drum 2, 2'.

According to the embodiment illustrated in FIG. 9, one cooling channel 42 is each comprised of a portion 44 provided in an end wall 43 of the cooling drum 2, 2' and directed radial with respect to the axis 1 of the cooling drum 2, 2', an axial portion 45 located below a web 15, a U-shaped deflection part 46, a further axially directed portion 45 located below the neighboring web 15, and a substantially radially directed portion 47 again located in the end wall 43.

In order to always supply the coldest coolant to those coolant channels 42 which are in the region below the site of impact 24 of the molten slag 4, cylindrical stationary coolant supply 48 and coolant discharge 49 means inserted in the end wall 43 of the cooling drum are each formed by four chambers 51, 52 arranged on the periphery of a cylindrical body 50. The neighboring chambers are separated from each other by webs 53, 54 extending in the circumferential direction and transversely thereto and are completely open outwards in the radial direction. The cooling drum 2, 2' is rotatable relative to the cylindrical body 50.

As is apparent from FIG. 13, in particular, the upwardly open uppermost chamber 51 includes an axially directed coolant entry nozzle 55. The coolant channels 42 that are just entering this chamber (the duct-like connection being effected via the radially directed portions 44 of the coolant channels 42) lead the cooling water, after having flown through the axial portions 45, to the axially neighboring uppermost chamber 52 of the coolant discharge means 49 by their radially directed portions 47, from where it gets, through a bottom opening 56 and a cavity 57 below the two chambers, to the chamber 51 neighboring the first chamber 51 of the coolant supply means 48 in the rotation direction of the cooling drum 2, 2', from which it is guided through the coolant channels 42 abutting on this chamber 51.

The cavities 57 connecting the chambers 51 and 52 of the coolant supply 48 and coolant discharge 49 means are designed as connection chambers extending over the chambers 51 of the coolant supply means 48 and the chambers 52 of the coolant discharge means 49 in the longitudinal direction (axial direction), which connection chambers are arranged concentric with the chamber 51, 52 of the coolant supply and coolant discharge means (see FIGS. 11 and 12). The connection chambers 57 are separated from each other by webs 58 directed radial and transverse to the circumferential direction, which webs 58 of the connection chambers 57 are located so as to be offset by 45°, in the circumferential direction, with respect to the webs 54 of the chambers 51, 52 of the coolant supply 48 and coolant discharge 49 means, which are directed radially and transverse to the circumferential direction.

As soon as the coolant has reached the coolant discharge means connection chamber 5 arranged in front of the uppermost chamber 51 in the rotation direction, it is discharged via a coolant discharge nozzle 59.

According to the embodiment illustrated in FIG. 10, the radially directed portions 44 of the coolant channels 42 functioning as supplies are provided in a first end wall 43 of the cooling drum 2, 2' and the portions 47 of the coolant channels 42 functioning as discharge ducts being provided in the opposite end wall 60 of the cooling drum 2, 2'. Accordingly, the coolant supply means 48 is located in the first end wall 43 and the coolant discharge means 49 is located in the second end wall 60.

The flow connection of the chambers 51 and 52 of the coolant supply means 48 and the coolant discharge means 49, according to the embodiment illustrated in FIG. 9, also is effected by connection chambers 57 offset by 45° in the circumferential direction and provided within a hollow cylindrical rod 61 connecting the coolant supply and coolant discharge means, which chambers also are separated from each other by webs 58 directed radial and transverse to the circumfernetial direction. Instead of the connection chambers 57, tube ducts or pipes may be provided to connect the chambers 52 of the coolant discharge means 49 with the pertaining chambers 51 of the coolant supply means 48.

With the exemplary embodiment illustrated, the separation of the coolant supply 48 and coolant discharge 49 means into four parts is illustrated, which constitutes the optimum with regard to the effects attained and the expenditures of manufacture for these means. Instead of the division into four parts, a division into two or more than four chambers may also be taken into consideration, the division being chosen in dependence on the diameter 35 of the cooling drum 2, 2' and of the heat to be conducted away.

The coolant channels 42 have the advantage that they allow for a high internal pressure despite the slight distance from the recesses 14 such that a very effective cooling and, thus a vitrification of the slag 4 are ensured.

The coolant heated up after having flown through the cooling drum 2, 2' may be conducted in a thermodynamic cycle for the recovery of sensible heat.

For especially long cooling drums, it may be suitable to provide several points of impact on the uppermost site of the cooling drum 2, 2'. To increase the output, it is, however, also possible to adjacently arrange two or more cooling drums instead of one long cooling drum, with the axes of the cooling drums preferably registering.

What we claim is:

1. An arrangement for the production of vitrified slag, such as blast furnace slag, including a rotating cooling drum provided with an internal cooling and recesses on its surface adapted to receive molten slag impinging on said cooling drum on a site of impact located on said cooling drum approximately in its uppermost point, the improvement which comprises cooling drum webs for separating said recesses in the circumferential direction of said cooling drum, said recesses being closed in the end regions of said cooling drum in the axial direction thereof, and a plurality of cooled counter rolls contacting said cooling drum webs by their surfaces and aligned with their axes parallel to the axis of said cooling drum, said counter rolls being arranged after said site of impact of said slag in the rotation direction of said cooling drum and one behind the other in the circumferential direction of said cooling drum.

2. An arrangement as set forth in claim 1, wherein said recesses are arranged closely adjacent in the circumferential direction, the width of said cooling drum webs being between 0.5 and 5 mm.

3. An arrangement as set forth in claim 1, wherein said cooling drum has a cylindrical surface connecting neighboring cooling drum webs so as to form a cross-section with the surface of each recess, no point of whose cross sectional area is spaced from the nearest cross sectional limitation by more than 10 mm.

4. An arrangement as set forth in claim 1, wherein at least three counter rolls are provided, the first and last ones of which counter rolls have smooth surfaces and the counter roll arranged therebetween, on its surface, being provided with elevations extending over its circumferential direction.

5. An arrangement as set forth in claim 1, further comprising pressing means for resiliently pressing said counter rolls against said cooling drum webs.

6. An arrangement as set forth in claim 1, wherein said recesses extend in the axial direction of said cooling drum.

7. An arrangment as set forth in claim 6, wherein said recesses are designed as grooves extending approximately over the entire length of said cooling drum.

8. An arrangement as set forth in claim 1, wherein said recesses have smooth surfaces of round cross sections.

9. An arrangement as set forth in claim 8, wherein said cross sections are circularly segment-shaped.

10. An arrangement as set forth in claim 9, wherein said circularly segment-shaped cross sections have a radius of from 10 to 40 mm.

11. An arrangement as set forth in claim 10, wherein said radius is about 15 mm.

12. An arrangement as set forth in claim 1, wherein said counter rolls have a diameter substantially smaller than the diameter of said cooling drum.

13. An arrangement as set forth in claim 12, wherein said diameter of said counter rolls is in a range of between 1/20 and 1/60 of the diameter of said cooling drum.

14. An arrangement as set forth in claim 1, wherein said site of impact of said slag, seen in the rotation direction of said cooling drum, lies closely in front of the apex of said cooling drum.

15. An arrangement as set forth in claim 14, wherein said site of impact of said slag lies in a range of from 3° to 10° in front of the apex of said cooling drum.

16. An arrangement as set forth in claim 1, wherein the first one of said plurality of counter rolls follows upon said site of impact of said slag in a range of from 5° to 15°.

17. An arrangement as set forth in claim 16, wherein the first one of said plurality of counter rolls follows upon said site of impact of said slag in a range of from 7° to 12°.

18. An arrangement as set forth in claim 1, further comprising at least one additional counter roll arranged in front of said site of impact of said slag, said additional counter roll having a smooth surface and also contacting said cooling drum webs.

19. An arrangement a set forth in claim 18, wherein said additional counter roll is spaced from said site of impact of said slag by 5° to 15°.

20. An arrangement as set forth in claim 19, wherein said additional counter roll is spaced from said site of impact of said slag by 7° to 12°.

21. An arrangement as set forth in claim 1, wherein said cooling drum has a cooling drum shell and a plurality of coolant channels are arranged in said cooling drum shell, said coolant channels extending substantially in the direction of the axis of said cooling drum and being adapted to accommodate coolant flowing therethrough.

22. An arrangement as set forth in claim 21, wherein one cooling channel is each provided closely below one of said cooling drum webs in radial direction.

23. An arrangement as set forth in claim 21, wherein each of said cooling channels includes radially directed channel portions, and further comprising stationary coolant suppy means divided into at least a first and second coolant supply means chamber in radial direction, stationary coolant discharge means divided into at least a first and second coolant discharge means chamber in radial direction, coolant feed duct means communicating with said first coolant supply means chamber, each of said cooling channels entering into a coolant supply means and a coolant discharge means by said radially directed channel portions, and coolant channels in communication with said first coolant supply means chamber entering into said first coolant discharge means chamber, a connecting channel for flow-connecting said first coolant discharge means chamber with said second coolant supply means chamber, and coolant discharge duct means flowconnected with a further one of said coolant discharge means chamber.

24. An arrangement as set forth in claim 23, wherein said coolant supply and coolant discharge means are designed as hollow ring cylinders, including radial webs for division into said chambers, said connecting channels connecting said chambers are provided centrally within said ring cylinders and said chambers have an open external periphery to receive said radially directed coolant channel portions.

25. An arrangement as set forth in claim 24, wherein said connecting channels connecting said chambers are formed by radially directed webs within a cylinder cavity connecting said coolant supply means and said coolant discharge means.

26. An arrangement as set forth in claim 1, further comprising sensors arranged laterally of said cooling drum near the ends of said recesses and adapted to respond at an overflow of said slag out of said recesses, and a control means adapted to reduce the amount of slag supplied per time unit when said sensors respond.

27. An arrangement as set forth in claim 26, wherein said sensors are temperature-sensitive sensors.

28. An arrangement as set forth in claim 26, further comprising a tundish and a tilting drive for tilting said tundish so as to reduce the amount of slag supplied per time unit when said sensors respond.

* * * * *